US009293869B2

(12) United States Patent
Ning et al.

(10) Patent No.: US 9,293,869 B2
(45) Date of Patent: Mar. 22, 2016

(54) ELECTRICAL CONNECTOR BOTH PREVENTING SCRAPPING TO AN INSULATIVE BODY AND REDUCING ANTENNA INTERFERENCE

(71) Applicant: FOXCONN INTERCONNECT TECHNOLOGY LIMITED, Grand Cayman (KY)

(72) Inventors: Qiang Ning, Kunshan (CN); Zhen-Sheng Wang, Kunshan (CN); Chang-Ji Liu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/604,645

(22) Filed: Jan. 23, 2015

(65) Prior Publication Data

US 2015/0207272 A1 Jul. 23, 2015

(30) Foreign Application Priority Data

Jan. 23, 2014 (CN) ..... 2014 1 0031248
Jan. 23, 2014 (CN) ..... 2014 1 0031419

(51) Int. Cl.

| | |
|---|---|
| ***H01R 13/648*** | (2006.01) |
| ***H01R 13/6594*** | (2011.01) |
| *H01R 12/72* | (2011.01) |
| *H01R 13/405* | (2006.01) |

(52) U.S. Cl.

CPC ..... *H01R 13/6594* (2013.01); *H01R 12/724* (2013.01); *H01R 13/405* (2013.01)

(58) Field of Classification Search

CPC ..... H01R 13/65802; H01R 13/658; H01R 13/6873; H01R 23/7073
USPC ..... 439/607.4, 607.27, 607.35
See application file for complete search history.

(56) References Cited

U.S. PATENT DOCUMENTS

| | | | | |
|---|---|---|---|---|
| 5,637,015 | A * | 6/1997 | Tan | H01R 23/6873 439/607.37 |
| 7,997,937 | B2 * | 8/2011 | Kondo | H01R 13/6477 439/607.4 |
| 8,801,463 | B2 * | 8/2014 | Tan | H01R 13/5202 439/607.04 |
| 8,808,030 | B2 * | 8/2014 | Gao | H01R 13/6271 439/607.4 |
| 8,845,363 | B2 | 9/2014 | Ardisana, II et al. | |
| 8,882,540 | B2 * | 11/2014 | Yen | H01R 27/00 439/489 |

FOREIGN PATENT DOCUMENTS

| | | |
|---|---|---|
| CN | 201904481 | 7/2011 |
| JP | 4875130 | 5/2011 |
| KR | 10-1355579 | 7/2013 |

* cited by examiner

*Primary Examiner* — Phuong Dinh
(74) *Attorney, Agent, or Firm* — Wei Te Chung; Ming Chieh Chang

(57) ABSTRACT

An electrical connector (100) includes an insulative body (2), a number of contacts (1), and a metal shell (5). The insulative body includes an upper wall (21), a lower wall (22) opposite to the upper wall, a pair of sidewalls (23), and a rear wall (24) connecting between the upper wall, the lower wall, and the sidewalls for cooperatively defining a receiving space (20). The insulative body has a mating tongue (25) extending forwardly from the rear wall into the receiving space. The contacts are retained in the mating tongue and partly exposed in the receiving space. The metal shell has a pair of arc portions engaging with a mating plug connector. The metal shell is positioned on the upper wall for reducing interference between the metal shell and an antenna mounted on a printed circuit board.

11 Claims, 14 Drawing Sheets

ELECTRICAL CONNECTOR BOTH PREVENTING SCRAPPING TO AN INSULATIVE BODY AND REDUCING ANTENNA INTERFERENCE

CROSS-REFERENCE TO RELATED APPLICATIONS

This patent application relates to a concurrently filed U.S. patent application entitled "ELECTRICAL CONNECTOR REDUCING ANTENNA INTERFERENCE," which is assigned to the same assignee as this application.

BACKGROUND OF THE INVENTION

1. Field of the Invention

The present invention relates generally to an electrical connector, and more particularly to an electrical connector both preventing scrapping to an insulative body and reducing antenna interference.

2. Description of Related Arts

Japan Pat. No. 4875130 issued to Hirose on Dec. 2, 2011 discloses an electrical connector comprising a metal shield with a receiving space, a plurality of contacts received in the receiving space of the metal shield, and an insulative body molding over the metal shield and retaining the contacts. The metal shield together with the contacts is insert-molded in one-shot via the insulative body. The insulative body forms an insulative cover adhering to an outside surface of the metal shield and a tongue portion extending forwardly into the receiving space for supporting the contacts. The metal shield usually has a large length along an insertion direction to extend from an insertion opening to an inner connecting surface between the insulative cover and the insulative body. The metal shield usually has a plurality of grounding tails to be soldered with a printed circuit board of an electronic device such as a mobile phone which usually has an antenna for both transmitting and receiving signals. Therefore, the metal shield has an antenna interference issue because a small distance between the metal shield and the antenna when the electrical connector is assembled on the printed circuit board of the electronic device.

U.S. Pat. No. 8,845,363 issued to Ardisana, II et al. on Sep. 30, 2014 discloses an electronic device including a receptacle connector. Reinforcing element may be embedded within an upper portion of shell adjacent to antenna of device. As the position of antenna may vary among electronic devices, so may the position of reinforcing element vary to be adjacent to antenna and embedded in shell. Some embodiments disclosed relate to improved receptacle connector shells that can provide for a smaller, stronger receptacle connector shell, increased Electromagnetic Interference and Electromagnetic Compatibility performance ("EMI/EMC performance"), and increased flexibility in the positioning of an antenna within the enclosure of an electronic device.

SUMMARY OF THE INVENTION

An object of the present invention is to provide an electrical connector both preventing scrapping to an insulative body and reducing antenna interference.

To achieve the above object, an electrical connector includes an insulative body, a number of contacts, and a metal shell. The insulative body includes an upper wall, a lower wall opposite to the upper wall, a pair of sidewalls, and a rear wall connecting between the upper wall, the lower wall, and the sidewalls for cooperatively defining a receiving space. The insulative body has a mating tongue extending forwardly from the rear wall into the receiving space. The contacts are retained in the mating tongue and partly exposed in the receiving space. The metal shell has a pair of arc portions engaging with a mating plug connector. The metal shell is positioned on the upper wall for reducing interference between the metal shell and an antenna mounted on a printed circuit board.

Other objects, advantages and novel features of the invention will become more apparent from the following detailed description when taken in conjunction with the accompanying drawings.

DETAILED DESCRIPTION OF THE PREFERRED EMBODIMENT

Figure 1:
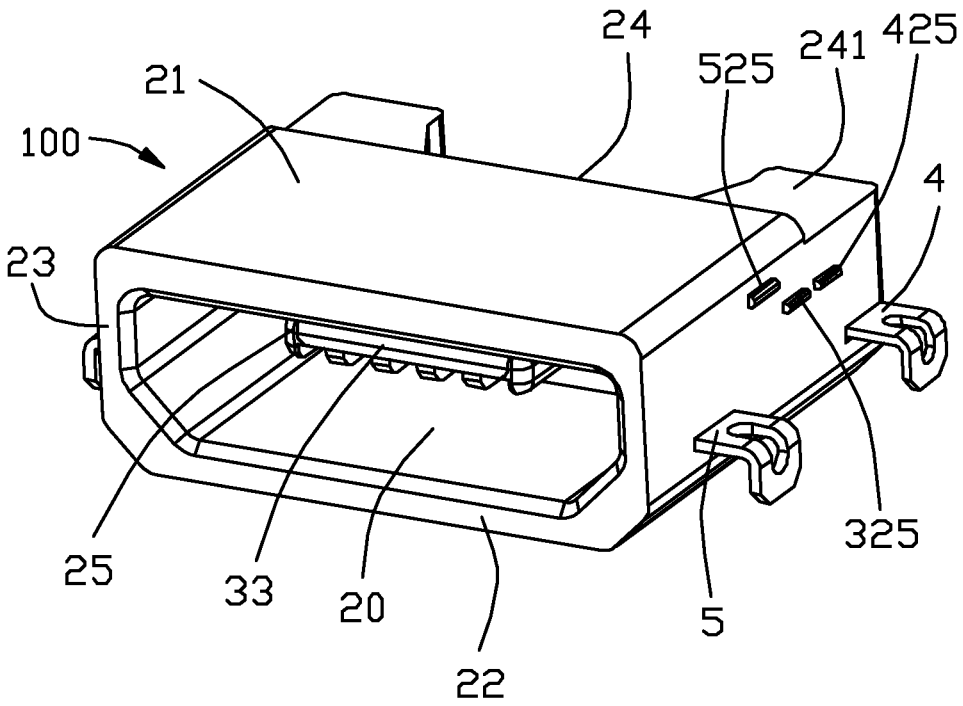
FIG. 1 is a perspective, assembled view of an electrical connector constructed in accordance with the present invention.
Figure 2:
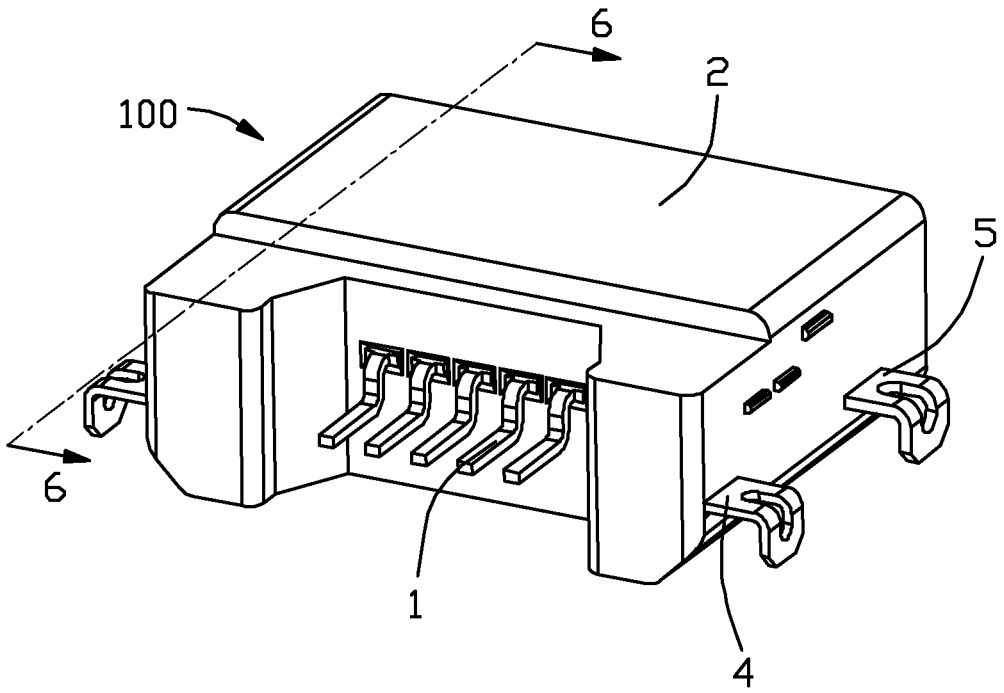
FIG. 2 is similar to but taken a different view from FIG. 1.

Reference will now be made in detail to the preferred embodiment of the present invention.

Referring to FIGS. 1-14, an electrical connector 100 of the present invention, used for receiving a mating plug connector (not shown), comprises a plurality of contacts 1, an insulative body 2 defining an receiving space 20 for receiving the contacts 1 and having a mating tongue 25 extending into the receiving space 20 for retaining the contacts 1, a reinforcing plate 3 retained in the mating tongue 25 for reinforcing the mating tongue 25, a pair of grounding plates 4 retained in a rear part of the insulative body 2, and a metal shell or bracket 5 retained at a front part of the insulative body 2 and partly exposed into the receiving space 20 for engaging with the mating plug connector and preventing the insulative body 2 from being scrapped by the mating plug connector.

Referring to FIGS. 3, 7, 11, and 12, each contact 1 comprises a front contacting portion 11 for connecting with the mating plug connector, a retaining portion 12 extending backwardly from the front contacting portion 11 for retained in the insulative body 1, and a rear soldering portion 13 extending backwardly from the retaining portion 12 and lower than the retaining portion 12 for being soldered with a printed circuit board 6 of an electronic appliance (not shown) such as a mobile phone which usually has an antenna (not shown) for both transmitting and receiving signals.

Figure 3:
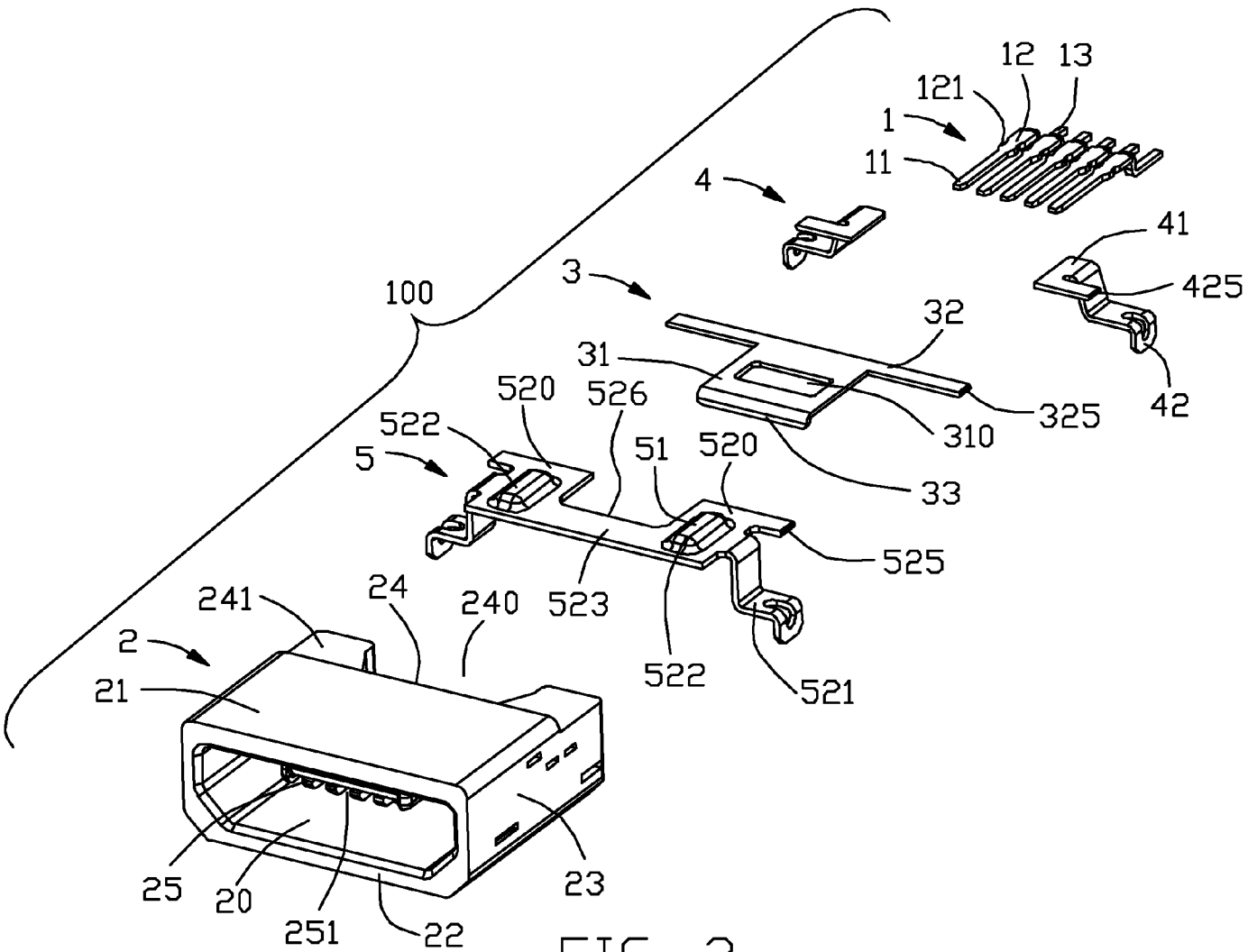
FIG. 3 is a perspective, fully exploded view of the electrical connector of FIG. 1.
Figure 4:
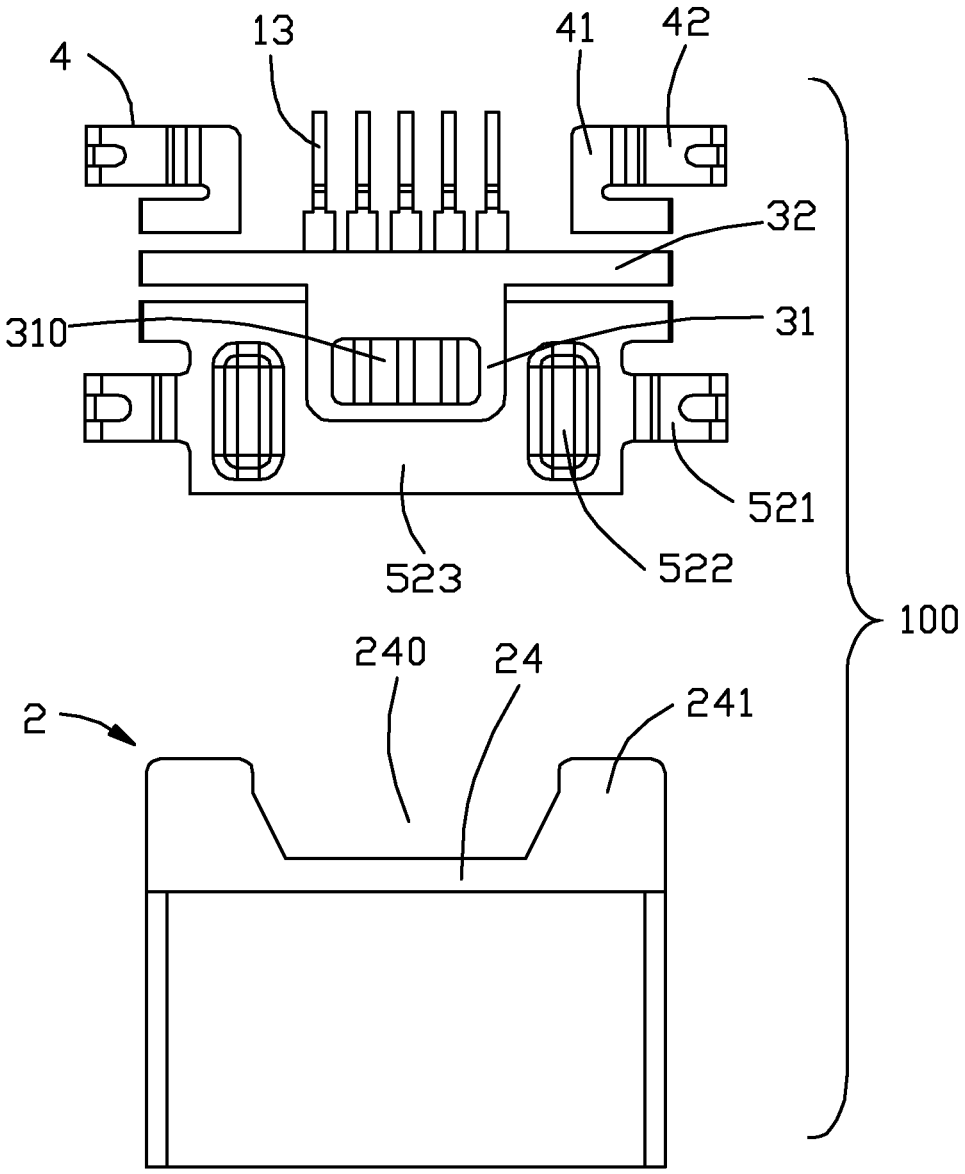
FIG. 4 is a top, elevational view of the electrical connector of FIG. 1 when the insulative body is separated from other parts of the electrical connector.
Figure 5:
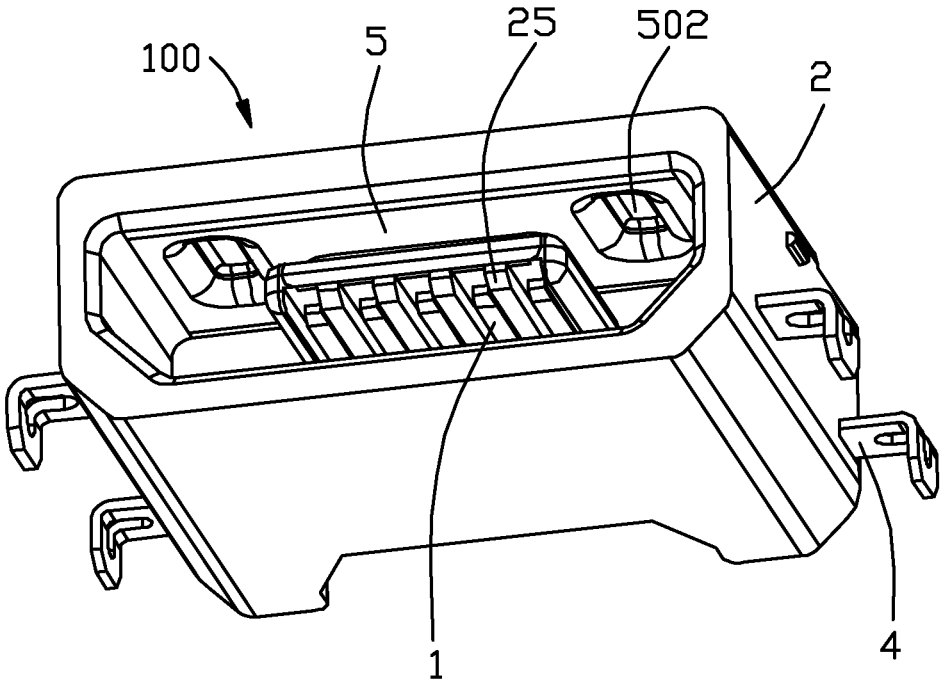
FIG. 5 is similar to but taken a different view from FIG. 1 and FIG. 2.
Figure 6:
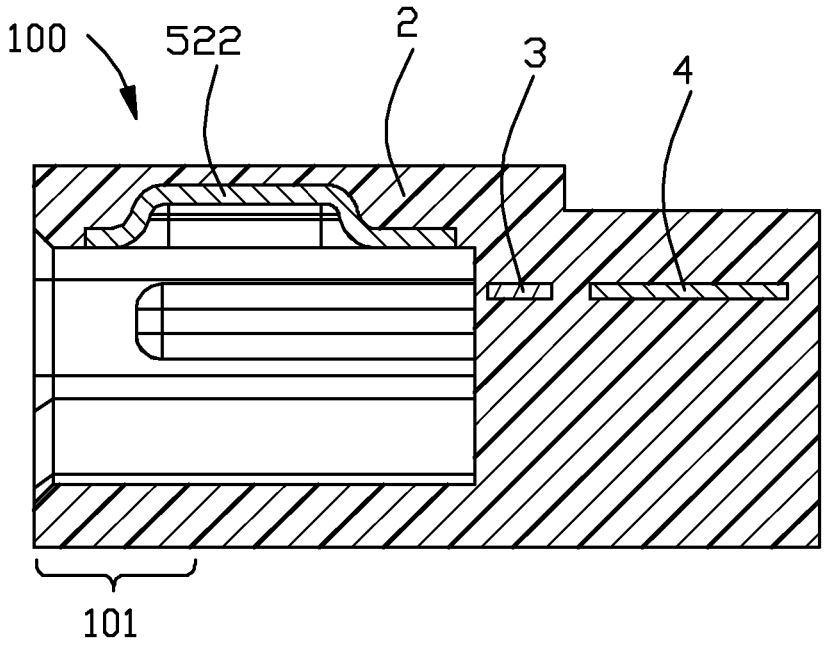
FIG. 6 is a cross-sectional view of the electrical connector when taken along line 4-4 of FIG. 1.
Figure 7:
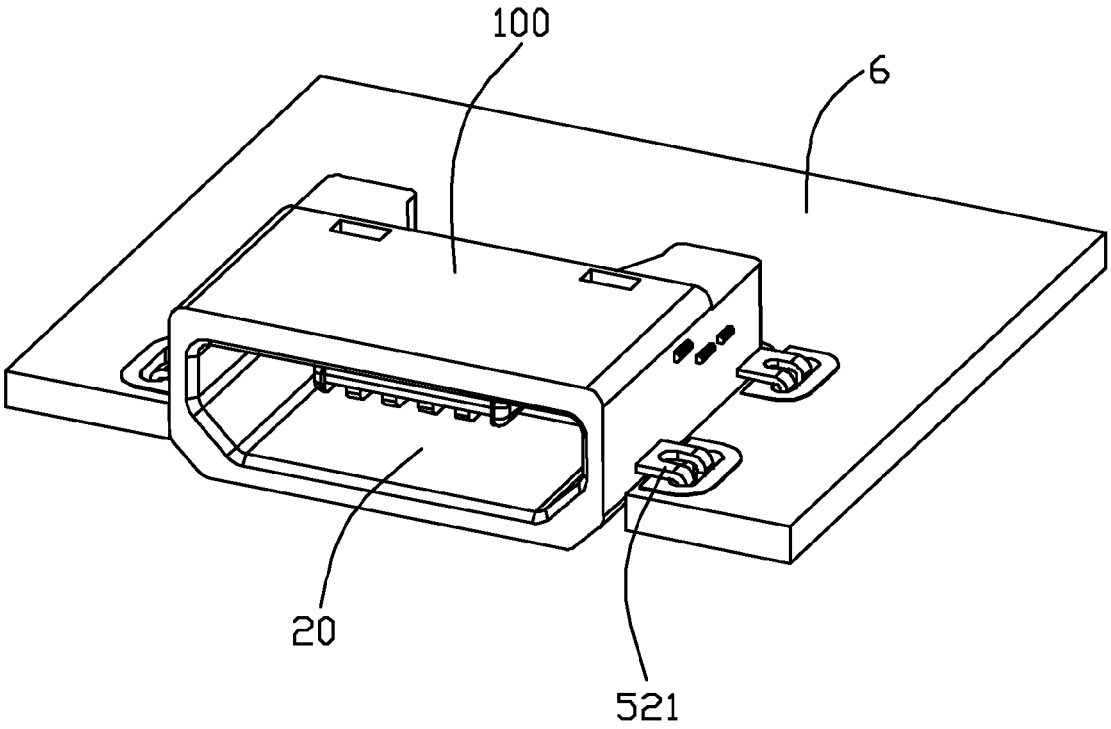
FIG. 7 is a perspective, assembled view of the electrical connector of FIG. 1 when the electrical connector is assembled on a printed circuit board.
Figure 8:
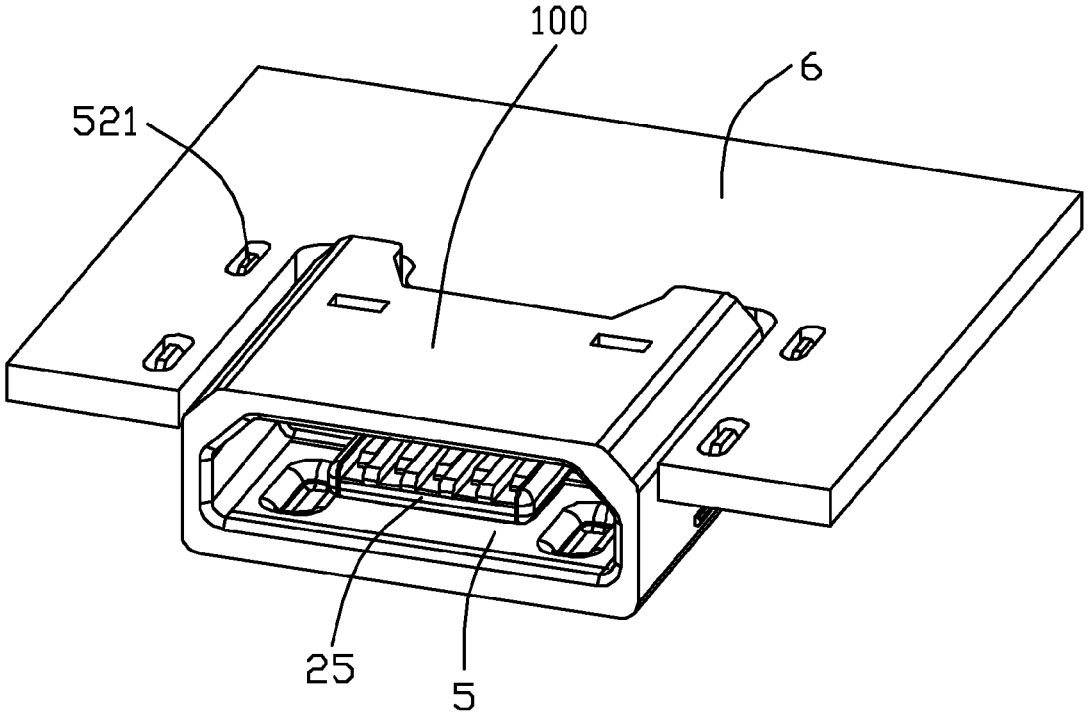
FIG. 8 is similar to but taken a different view from FIG. 7.
Figure 9:
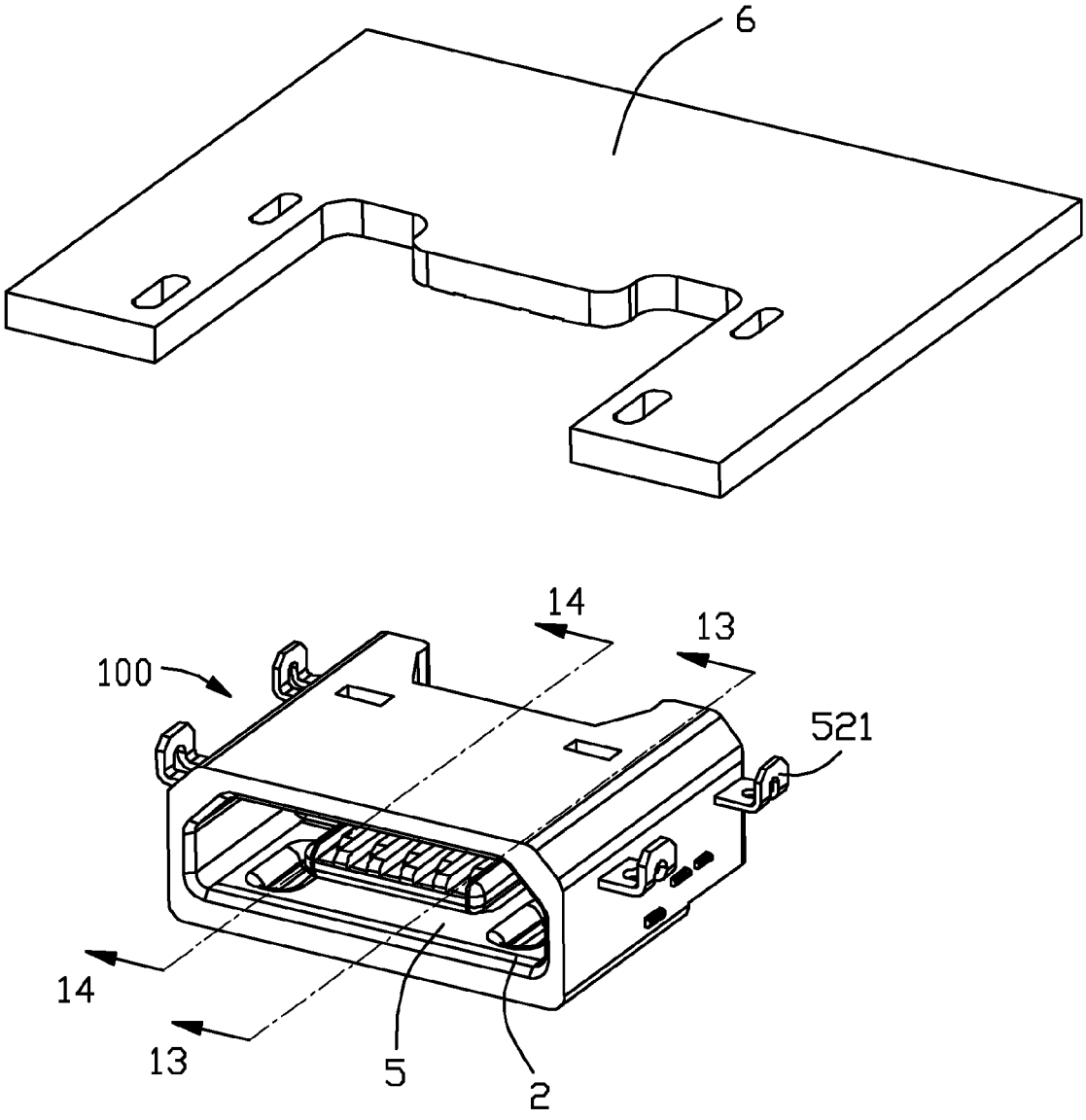
FIG. 9 is a perspective, exploded view of the electrical connector from the printed circuit board of FIG. 8.
Figure 10:
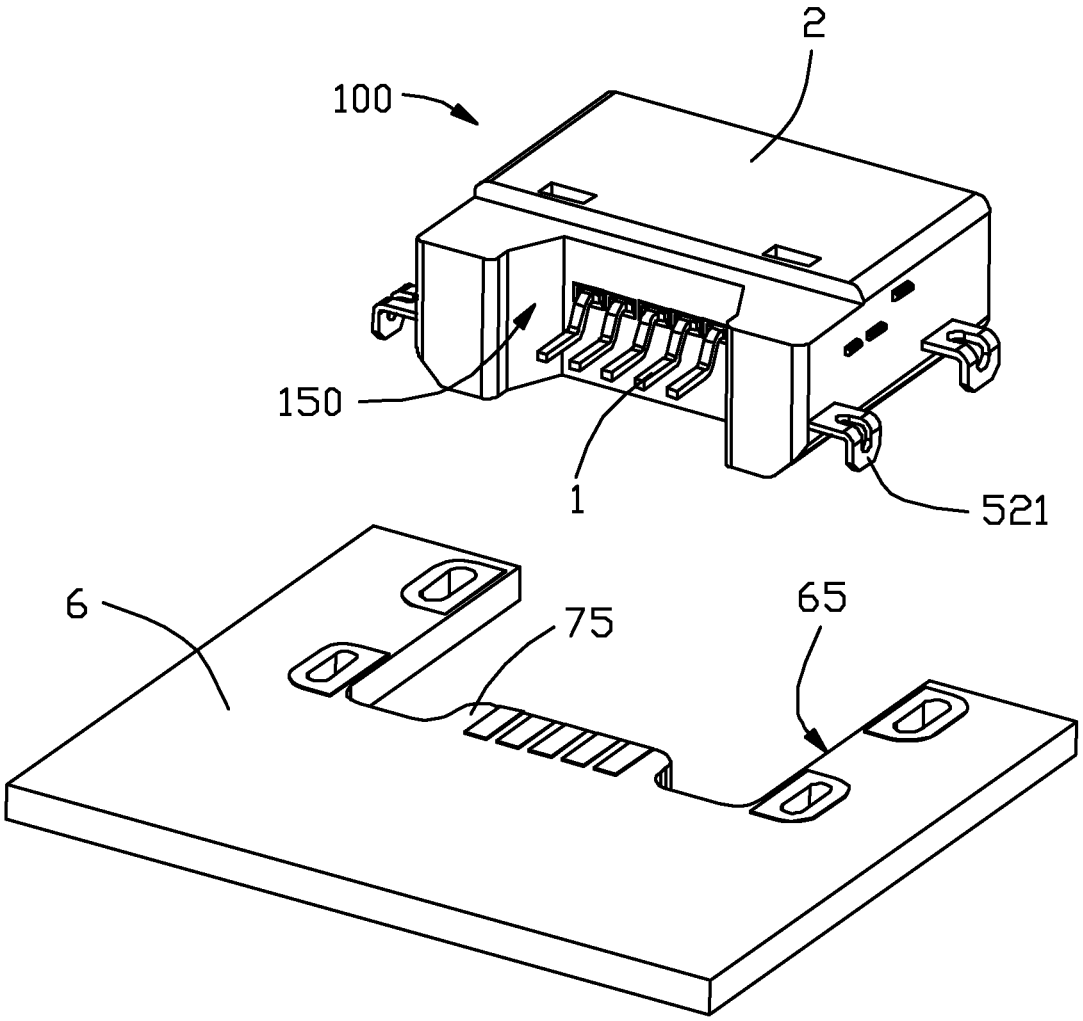
FIG. 10 is similar to but taken a different view from FIG. 9.

Referring to FIGS. 3 and 9-10, the insulative body 2 is over-molded outside of the metal shell 5, the contacts 1, the reinforcing plate 3, and the grounding plates 4. The insulative body 2 comprises an upper wall 21, a lower wall 22, a pair of sidewalls 23, and a rear wall 24 connecting between the upper wall 21, the lower wall 22, and the sidewalls 23 for cooperatively defining the receiving space or mating cavity 20. The mating tongue 25 extends forwardly from the rear wall 24 into the receiving space 20. The contacting portions 11 of the contacts 1 extend beyond the mating tongue 25 to be exposed in the receiving space 20 for engaging with the mating plug connector.

Referring to FIGS. 3 and 9-10, the reinforcing plate 3 comprises a base portion 31, a front end portion 33 curvedly extending from a front margin of the base portion 31, and a pair of fixing legs 32 extending rearwardly and horizontally from the base portion 31. The fixing legs 32 oppositely extend outside of the insulative body 2 along the transverse direction. The base portion 31 is positioned below the mating tongue 25 and the base portion 31 defines a transverse slot 310. The mating tongue 25 extends into the transverse slot 310 for retaining the reinforcing plate 3 with the insulative body 2. The front end portion 33 upwardly catch with a front edge of the mating tongue 25 for retaining the reinforcing plate 3 with the insulative body 2, too. The reinforcing plate 3 is made from metal material which is more rigid than plastic material of the insulative body 2, and therefore, the reinforcing plate 3 prevents the mating tongue 25 from accidently being broken.

Referring to FIG. 3, the grounding plates 4 are retained in the rear wall 24 of the insulative body 2. Each grounding plate 4 comprises a horizontal portion 41 retained in the insulative body 2 and a vertical portion or another board lock 42 integral with the horizontal portion 41 for connecting with the printed circuit board 6.

Figure 11:
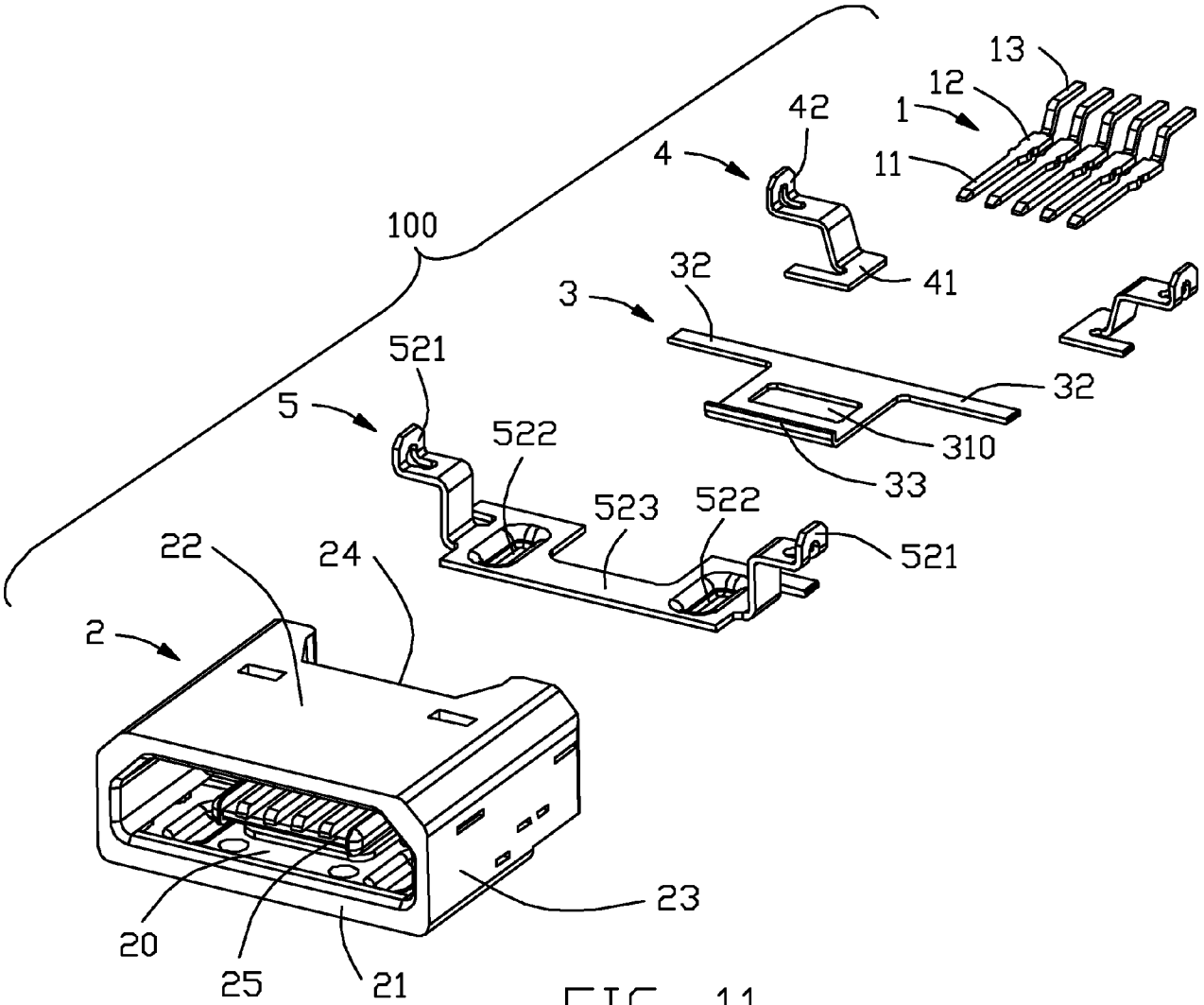
FIG. 11 and FIG. 12 are perspective, fully exploded view similar to but taken different views from FIG. 3.
Figure 12:
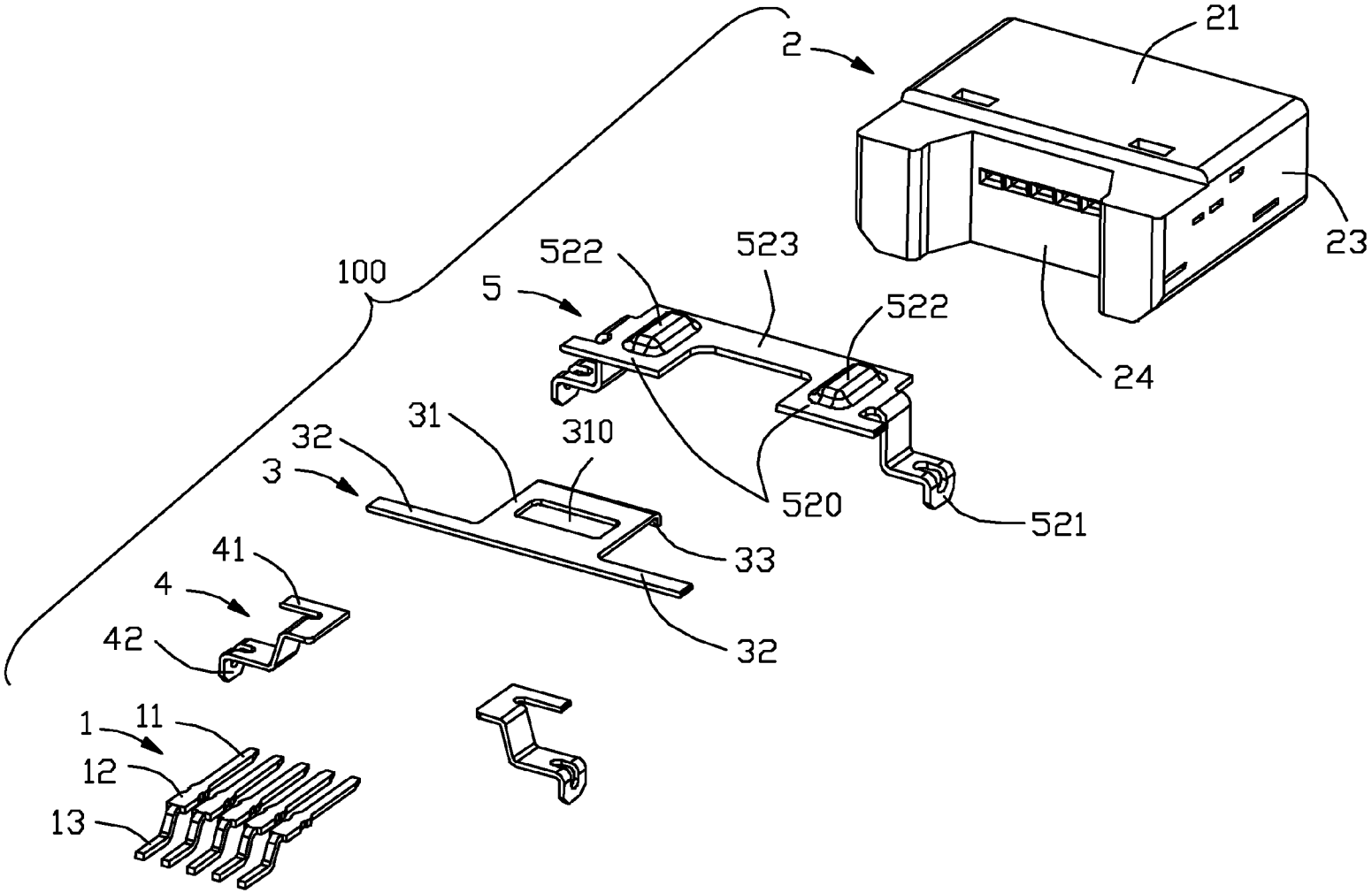
Figure 13:
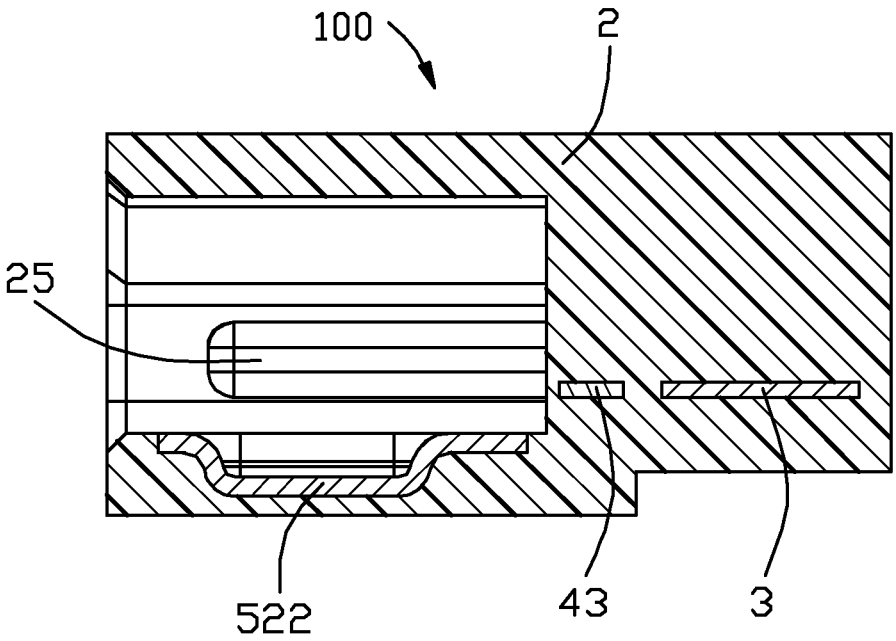
FIG. 13 is a cross-sectional view of the electrical connector when taken along line 13-13 of FIG. 9.
Figure 14:
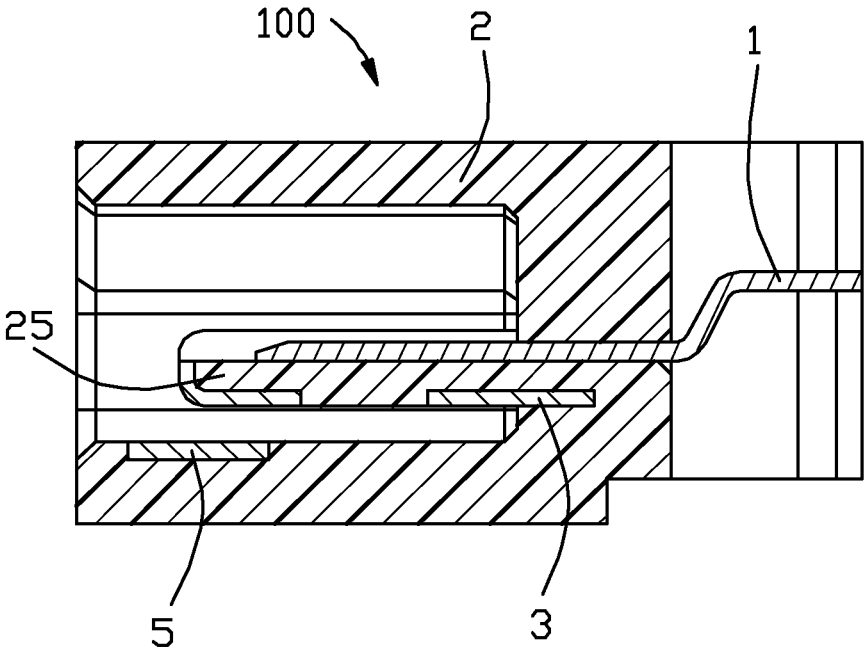
FIG. 14 is a cross-sectional view of the electrical connector when taken along line 14-14 of FIG. 9.

Referring to FIGS. 3 and 11-12, the metal shell 5 is plate shaped and is retained in the upper wall 21 of the insulative body 2. The metal shell 5 comprises a pair of locking portions 520, a connection portion 523 connecting between the locking portions 520, and a pair of board locks 521 extending downwardly for securing into the printed circuit board 6. Each locking portion 520 forms an arc portion 522 arching outwardly away from the receiving space 20 for engaging with a pair of latches (not shown) of the mating plug connector. The metal shell 5 has a length along a front-and-rear direction smaller than that of the receiving space 20. Therefore, the electrical connector 100 reduces antenna interference. Alternatively speaking, the metal shell 5 on the upper wall 21 has a length as small as possible extending along the front-and-rear direction for avoiding the antenna which is usually positioned on the lower wall 22. For example, the locking portions 520 are essential because the arc portions 522 of the locking portions 520 are used for engaging with the latches of the mating plug connector, however, a minimum size of the connection portion 523 between the locking portions 520 is 0.

The metal shell 5 is positioned on an upper wall 21 and engaging with a pair of latches of a mating plug connector for preventing scrapping to the insulative body 2 of the electrical connector 100. The metal shell 5 is positioned on the upper wall 21 and the antenna is positioned on the printed circuit board which the lower wall 22 is assembled on, for reducing interference between the metal shell 5 and the antenna. On the other hand, because the whole connector is made via an insert molding process, the metal shell 5 has a pair of end sections 525, the reinforcing plate 3 has a pair of end sections 325, and the grounding plate 4 has a pair of end sections 425 exposed to an exterior on the corresponding surfaces of the side walls 23 for linking to the corresponding carrier during the insert-molding process which will be removed once finished. Moreover, the metal shell 5 forms a cutout 526 between two locking portions 520 for reducing the shielding area and the corresponding antenna effect. In brief, compared with the traditional one piece connector, the instant invention uses the non-frame type bracket 3 to replace the frame type shell for cooperating with the pair of latches of the plug connector. On the other hand, the shell 5 is secured to the printed circuit board without grounding while the board locks 42 of the grounding plate 4 in addition to the shell 5 are not only secured to the printed circuit board but also grounded. It is also noted that in this embodiment the printed circuit board forms a notch 65 and the connector with a recessed portion 150 in the rear side is received therein wherein the inner edge of the printed circuit board forms a protruding mounting region 75 extending into the notch of the printed circuit board and thus also into the recessed portion of the connector for soldering the contacts thereto, referring to FIG. 10. Notably, the soldering between the tails of the contacts of the connector and the corresponding circuit pads on the protruding mounting region can be efficiently protected in this embodiment.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector for mounting on a printed circuit board, comprising:

an insulative body comprising an upper wall, a lower wall opposite to the upper wall, a pair of sidewalls, and a rear wall connecting between the upper wall, the lower wall, and the sidewalls for cooperatively defining an receiving space, the insulative body having a mating tongue extending forwardly from the rear wall into the receiving space;

a plurality of contacts retained in the mating tongue and partly exposed in the receiving space for engaging with a mating plug connector;

a metal shell having a pair of arc portions for engaging with the mating plug connector;

wherein the metal shell is positioned on the upper wall for reducing interference between the metal shell and an antenna mounted on the printed circuit board, wherein the metal shell has a length along a front-and-rear direction smaller than that of the receiving space, wherein the metal shell comprises a pair of locking portions and a connection portion connecting between the locking portions, and the arc portions are respectively positioned on the locking portions and separated away from each other by the connection portion.

2. An electrical connector assembly comprising:

an insulative housing including a base portion with a mating tongue extending forwardly therefrom in a front-to-back direction;

said insulative housing defining a mating cavity in which said mating tongue extends horizontally;

a plurality of contacts disposed in the housing with contacting sections exposed upon one surface of the mating tongue;

a metallic plate disposed in the housing and exposed upon the other surface of the mating tongue; and a metallic bracket embedded within the housing with a pair of locking portions communicating with the mating cavity, and a pair of board locks exposed outside of the housing for mounting to a printed circuit board without grounding but retaining thereto; wherein the contacts, the metallic plate and the metallic bracket are all integrally formed with the housing via an insert molding process, wherein said bracket forms two opposite end sections exposed upon two opposite side walls of the housing for linking to a corresponding carrier during the insert molding process, wherein said metallic plate includes two opposite end sections exposed to the opposite side walls and located behind the opposite end sections of the metallic bracket, further including another pair of metallic board locks secured to the housing via said insert molding process, wherein each of said board locks includes a vertical sections for locking to the printed circuit board and an end section exposed to the corresponding side wall for linking to a corresponding carrier, the end section of said another board lock being located behind the end section of the metallic bracket and the end section of the metallic plate, wherein said another pair of board locks are configured to be grounded to the printed circuit board.

3. The electrical connector assembly as claimed in claim 2, wherein said bracket essentially does not surround said mating cavity but with at least one interior face of the housing exposed to the mating cavity without being shielded by the metallic bracket.

4. The electrical connector assembly as claimed in claim 3, wherein said bracket includes a cutout between said pair of locking portions.

5. The electrical connector assembly as claimed in claim 2, wherein the housing is received within a notch of the printed circuit board while the metallic bracket is essentially located above the printed circuit board.

6. The electrical connector assembly as claimed in claim 2, wherein the metallic bracket is dimensioned around one half of the housing along a front-to-back direction.

7. An electrical connector assembly comprising:

a printed circuit board defining a notch with a protruding mounting region extending from an inner edge into the notch;

an electrical connector including:

an insulative housing including a base portion with a mating tongue extending forwardly therefrom in a front-to-back direction;

said insulative housing defining a mating cavity in which said mating tongue extends horizontally;

a plurality of contacts disposed in the housing with contacting sections exposed upon one surface of the mating tongue;

a metallic plate disposed in the housing and exposed upon the other surface of the mating tongue;

a metallic shell embedded within the housing with a pair of locking portions communicating with the mating cavity, and a pair of board locks exposed outside of the housing for mounting to said printed circuit board; and the housing forms a recessed portion in a rear side and tails of the contacts are disposed in said recessed portion; wherein the housing is located in the notch and the protruding mounting region is received within the recessed portion and soldered to tails of the connector, wherein the metallic shell is integrally formed with the housing via an insert molding process, and the metallic shell forms two opposite end sections exposed on two opposite side walls of the housing for linking to a corresponding carrier during said insert molding process, wherein the metallic plate is integrally formed with the housing via said insert molding process, said metallic plate forms opposite end sections exposed on the two opposite side walls of the housing for linking to a corresponding carrier during the insert molding process, and the end sections of the metallic plate being located behind those of the metallic shell, further including another pair of board locks integrally formed with the housing via said insert molding process, wherein said board locks include a pair of end section exposed upon two opposite side walls, respectively, said end sections of said another pair of board lock being located behind both those of the metallic plate and those of the metallic shell.

8. The electrical connector assembly as claimed in claim 7, wherein both the pair of board locks and said another pair of board locks include horizontal sections seated upon the printed circuit board and vertical sections extending into corresponding holes in the printed circuit board.

9. The electrical connector assembly as claimed in claim 7, wherein the metallic shell does not fully surround the mating cavity but leaving one side face of the mating cavity exposed to an interior face of the housing.

10. The electrical connector assembly as claimed in claim 7, wherein the metal shell forms a cutout between the pair of locking portion.

11. The electrical connector assembly as claimed in claim 7, wherein the metallic bracket is dimensioned around one half of the housing along a front-to-back direction.

* * * * *